US007165343B2

(12) United States Patent
Fukui

(10) Patent No.: US 7,165,343 B2
(45) Date of Patent: Jan. 23, 2007

(54) SHOE WITH FIXTURES FOR WALKING ON A SLOPE

(76) Inventor: Tomio Fukui, 18-5, Kamiuma 4-chome, Setagaya-ku, Tokyo 154-0011 (JP)

( * ) Notice: Subject to any disclaimer, the term of this patent is extended or adjusted under 35 U.S.C. 154(b) by 0 days.

(21) Appl. No.: 10/473,540

(22) PCT Filed: Apr. 1, 2002

(86) PCT No.: PCT/JP02/03275

§ 371 (c)(1),
(2), (4) Date: Sep. 30, 2003

(87) PCT Pub. No.: WO02/078479

PCT Pub. Date: Oct. 10, 2002

(65) Prior Publication Data

US 2004/0111925 A1 Jun. 17, 2004

(30) Foreign Application Priority Data

Mar. 30, 2001 (JP) ..... 2001-102270

(51) Int. Cl.
*A43B 7/16* (2006.01)

(52) U.S. Cl. ..... 36/81; 36/136

(58) Field of Classification Search ..... 36/136, 36/7.6, 81

See application file for complete search history.

(56) References Cited

U.S. PATENT DOCUMENTS 380,395 A * 4/1888 Kramer ..... 36/7.6
1,107,208 A * 8/1914 Styche ..... 36/7.6
1,232,114 A * 7/1917 Sorley ..... 36/7.6
2,484,389 A * 10/1949 Schatz ..... 36/7.6

(Continued)

FOREIGN PATENT DOCUMENTS

JP 42-11251 6/1967

(Continued)

OTHER PUBLICATIONS

Translation of JP 42-11251.

(Continued)

*Primary Examiner*—Ted Kavanaugh
(74) *Attorney, Agent, or Firm*—Bromberg & Sunstein LLP

(57) ABSTRACT

The shoe with fixtures for walking on a slope comprises a U-shaped base-member 11, having a bottom base-member 11*b* and two arm base-members 11*a* extending upward from both ends of the bottom base-member 11*b*, for being fitted in the heel portion 4, two shafts 12*b* fixed almost in the middle of each of both arm base-members 11*a* a U-shaped adjusting-member 16, which has a bottom adjusting-member 15 and two arm adjusting-members 14 fixed to both ends of the bottom adjusting-member 15 at a vicinity of the lower end of the arm adjusting-member 14 two holes 14*a*, arranged almost in the middle of each arm adjusting-member 14 for engaging with the shafts 12*b*, and two clamping members 13 or set nuts 12*a* for fastening the U-shaped adjusting-member 16 to the U-shaped base-member 11, wherein the U-shaped adjusting-member 16 is rotated or turned almost vertically to be adjusted and fastened at an appropriate height of the heel portion 4 to the U-shaped base-member 11 by the set nuts 12*a*.

14 Claims, 13 Drawing Sheets

U.S. PATENT DOCUMENTS

| | | | | | |
|---|---|---|---|---|---|
| 2,968,878 | A | * | 1/1961 | King | 36/61 |
| 3,268,927 | A | * | 8/1966 | Markowitz | 36/136 |
| 3,726,028 | A | * | 4/1973 | Stokes | 36/113 |
| 3,879,864 | A | * | 4/1975 | Exley | 36/61 |
| 4,291,473 | A | * | 9/1981 | Sartor | 36/132 |
| 4,693,022 | A | * | 9/1987 | Terhune | 36/132 |

FOREIGN PATENT DOCUMENTS

| | | |
|---|---|---|
| JP | S62-196004 U1 | 12/1987 |

OTHER PUBLICATIONS

Translation of JP S62-196004-U1.

* cited by examiner (a)

(b)

(a)

(b)

(a)

(b)

(a)

(b)

(a)

(b)

(a)

(b)

(a)

(b)

(a)

(b)

(a)

(b)

SHOE WITH FIXTURES FOR WALKING ON A SLOPE

This application is a 371 of PCT/JP02/03275 filed on Apr. 01, 2002.

FIELD OF THE INVENTION

This invention relates to a pair of shoes, and, particularly, to a pair of mountaineering shoes for climbing up and down a slope, while keeping an upright profile.

BACKGROUND OF THE INVENTION

When a person walks on flat land, the bottoms of his footwear (termed "the soles" in the following), such as a pair of shoes, positioned on the land are kept almost horizontal, and the center of gravity of his body is generally positioned right above his heels. This is the most suitable posture for a human's natural walk (termed "the natural posture" in the following).

On the contrary, when a person goes up a slope, the toes of his shoes as put on the slope are positioned more highly than the heels. Also, it is difficult to keep the natural posture while so walking. Therefore, it is necessary to keep the soles horizontally against the slope by lifting the heel of each shoe high in order to maintain the natural posture.

Conventionally, there have been a pair of mountaineering shoes installed with supporting equipment in heels of mountaineering shoes (see JP-S42-11251-Y). But, it was necessary for the equipment to be changed to correspond to each size of these shoes.

Further, there was a mountaineering fixture having an almost semicircular-shaped base, which is installed at the arched portion of the shoes (see JP-S62-196004-U1). The specification of this device states that there are advantageous effects to reduce muscle fatigue around an arch portion of a foot and leg fatigue because of supporting the body weight by the arch portions of the feet instead of the heel portions.

But, it was necessary for the equipment to be changed to correspond to each size of these shoes.

But, these almost semicircular-shaped fixtures for the mountaineering shoes have to be fixed to the shoes on a slope, or to be removed from the shoes and to be carried on flat land. Besides, in order to fix these fixtures to ordinary mountaineering shoes, it is necessary to prepare separate fixing tools.

Although it may be possible to surely reduce the muscle fatigue around an arch portion of a foot that is caused by supporting the body weight by means of the arch portions, there is a problem in that an unstable feeling, caused by shortening the distance between the two supporting points of a foot for supporting the body weight, may adversely increase the muscle fatigue of a leg, particularly, the heel and calf under the center of gravity of the body weight.

Also, shoe soles should be kept almost horizontal, particularly by lifting the toe of each sole, in descending a slope as well as in ascending a slope.

Furthermore, to walk transversely on a slope, the height of the shoe on the valley side may be adjusted so as to be higher than that of the shoe on the mountain side, and the heights of both shoes may preferably be equal.

It is an object of the present invention provide a pair of shoes having parts for keeping the natural posture despite going up or down a slope.

It is a further object of the present invention is to provide a pair of shoes with fixtures for walking on a slope and also in a flat place while maintaining the natural posture by adjusting the height of the heel, the toe, or the arched portion.

SUMMARY OF THE INVENTION

In order to solve the above problems, a shoe with a fixture for walking on a slope according to the first embodiment of the present invention comprises a U-shaped base-member (11), which has a bottom base-member and two side base-members extending from both end portions of the bottom base-member, fitted in a heel portion of the shoe, two shafts (12*b*) fixed to (almost in the middle of) each of two side base-members, a U-shaped adjusting-member 16, which has a bottom adjusting-member 15 and two side adjusting-members 14 fixed at both end portions of the bottom adjusting-member 15, two holes (14*a*), for respectively engaging with the shaft, arranged in (almost in the middle of) each of two side adjusting-members, and two clamping members (13, 12*a*) for clamping the U-shaped adjusting-member to the U-shaped base member via the shafts and the holes, wherein the U-shaped adjusting-member is rotated vertically, and adjusted at an appropriate height in accordance with the angle of a slope and clamped to the U-shaped base-member so that a man wearing a pair of the shoes climbs the slope while keeping his natural posture.

Also, regarding the fixture, installed in the shoe for walking on a slope, of the first embodiment, the U-shaped adjusting-member 16 may be rotated or turned backward 90 degrees or more from the surface of the sole so that the height of the heel of the shoe can be adjusted to be at an appropriate position.

Next, regarding the fixture, installed in the shoe for walking on a slope, of the first embodiment, the U-shaped adjusting-member 16 may include a clamping member 13, which has a hole in the center thereof, and side adjusting-members (or sliding adjusting-members) 14, which have a longitudinal slot 14*a* for sliding up or down and for further adjusting the height of the heel in accordance with the angle of a slope and with the bottom member fixed to the end or the vicinity of the sliding member.

Further, the sliding adjusting-member may have another longitudinal slot parallel to the above-mentioned slot. The clamping member (13) may have rims, arranged parallel in both sides of the member, for holding the sliding adjusting-member. The sliding adjusting-member may have another longitudinal slot parallel to the first longitudinal slot and the clamping member may have a little projection sliding in said another longitudinal slot. Other means for keeping both members parallel may be arranged.

In any embodiment as mentioned above, regarding the shoe with the fixture for walking on a slope, the length from the hole for fixing the U-shaped adjusting-member to the bottom adjusting-member must be sufficiently longer than the length from the hole to the rear end of the heel.

Furthermore, the shafts (12*b*) fixed to the base member may be arranged as one shaft that goes through the base member and the heel.

Moreover, the clamping member may be a set nut screwing onto the shaft. Also, the clamping member may comprise a spring projection arranged at a predetermined interval from the shaft fixed to the side base-member and projecting outward from the side base-member by a compressive force of a spring or a ring which is fixed to the side-adjusting member and rotatably arranged to the side base-member, having a plurality of through holes at certain intervals on a circle, for engaging with the spring projection, wherein the ring and the U-shaped adjusting member are fastened at the desired angle by engaging the spring projection with one of the through holes and the spring projection is disengaged from the through hole by pushing the projection into the base member from said through hole.

According to another embodiment of the present invention, a shoe with a fixture for walking on a slope comprises one or more hollow cylinders, one or more vertical arm members, each of which slides in the cylinder member, corresponding to the number of the cylinder members, and one or more clamping members for respectively fastening the vertical arm members to the cylinders at a desired position, wherein the adjusting member and the height of a heel portion are adjusted at an appropriate position in accordance with the angle of a slope when climbing the slope.

Also, in the shoe with a fixture for walking on a slope of the embodiment, one or more circular or angular cylinders may be adopted. A plurality of adjusting members (arm members) sliding in the cylinders may be fixed to a bottom adjusting-member at their lower ends. In the shoe with a fixture for walking on a slope, a clamping member may be a set screw for clamping the arm member to the cylinder. The cylinder may be arranged with a threaded hole for the set screw. Further, the arm member may have a plurality of transversal slots or recesses for engaging with the set screw on its surface.

When arranging a plurality of cylinders, a spring projection may be installed in each of the cylinders at a same height. Further, all these spring projections may be arranged in a bar. Each arm member sliding in the cylinder may have a plurality of recesses or slots for engaging the spring projection. By drawing out all these spring projections, the arm members may be slid up or down, and adjusted at an appropriate height and fastened there by releasing all the spring projections to be engaged with the recesses or slots.

Furthermore, the shoe with a fixture for walking on a slope according to another embodiment of the present invention comprises a U-shaped base-member which has two arm base-members extending upward from both ends of a bottom base-member, for being fitted in a toe portion, the bottom base-member and two shafts being fixed almost to the center of the arm base-members, a U-shaped adjusting member, which has two arm adjusting-members longer than the arm base-members, including a hole, which is arranged almost in the middle of each of the arm adjusting-members, for being fitted to the shaft, a clamping member for engaging with the shaft and fastening the U-shaped adjusting member to the U-shaped base-member, wherein, in descending a slope, the U-shaped adjusting member is rotated or turned almost vertically and fastened at an appropriate height of the toe to the U-shaped base-member by the clamping member.

According to the shoe with a fixture for walking on a slope of the embodiment, the U-shaped adjusting member may be rotated forward 90 degrees or more from an almost vertical position and adjusted at a desired height of the toe, in accordance with the angle of a slope.

According to the shoe with a fixture for walking on a slope of the embodiment, the U-shaped adjusting member may comprise two clamping members, each of which has a hole, and two slidable adjusting members, each of which has a longitudinal slot. In this case, the bottom adjusting-member of the U-shaped adjusting-member may be fixed at the lower end portion of two slidable adjusting-members and the slidable adjusting-members may be slid down in accordance with the angle of a slope.

The clamping member may comprise rims, arranged in both sides of the clamping members, for holding the slidable adjusting member. The sliding adjusting-member may have another longitudinal slot parallel to the above-mentioned slot. The clamping member may have a little projection sliding in said another longitudinal slot. The other means for keeping both members parallel may be so arranged.

About the shoe with the fixture for walking on a slope, the length from the hole for fixing the U-shaped adjusting-member to the bottom adjusting-member may be longer than half of the horizontal length of the heel portion.

Furthermore, the shaft fixed to the base member may be made as one shaft which goes through the base member and the heel.

Moreover, regarding any shoe with a fixture for walking on a slope, the clamping member may include a set nut screwed onto the shaft. Also, the clamping member may comprise a spring projection arranged at a predetermined interval from the shaft fixed to the side base-member and projected outward from the side base-member by a compressive force of a spring, and a ring, which is fixed to the side adjusting-member and rotatably arranged to the side base-member, having a plurality of through holes at certain intervals on a circle, for engaging with the spring projection, wherein the ring and the U-shaped adjusting member are fastened at the desired angle by engaging the spring projection with one of the through holes and the spring projection is disengaged from the through hole by pushing the projection into the base member from said through hole.

Further, the fixtures may be adopted to the heel and the toe of the shoe, according to the functions of the embodiments, as mentioned above, of the present invention.

Further, according to another embodiment of the present invention, the shoe with a fixture for walking on a slope may comprise two diagonal-bracing members supported between the U-shaped adjusting-member and the base-member, and having a plurality of notches arranged in one side of the diagonal-bracing member, wherein the upper ends of the two side base-members are bent rearward at right angles at the same horizontal position as the rear end of the sole and have the second shaft at their end portion like the first shaft fixed to the base-member, and wherein a lower end of the diagonal-bracing member is pivoted at the lower end of the side adjusting-member and one of the notches is engaged and fastened to the second shaft so that the U-shaped adjusting-member is fixed at an appropriate angle and height, and wherein the diagonal-bracing member is turned around the side adjusting-member, and one of the notches is engaged and fastened to the first shaft when the diagonal-bracing member is not used.

The shoe with a fixture for walking on a slope according to another embodiment comprises a U-shaped base-member, including a bottom base-member and two side base-members extending upward from both ends of the bottom base-member, fitted around both sides and a bottom of the arched portion of the shoe, one or more cylinders, which are round or angular in their sectional views, vertically fixed to each of both side base-members, a U-shaped adjusting-member, including a bottom adjusting-member and one or more arm adjusting-members fixed to the bottom adjusting-member, each of the arm adjusting-members sliding in each of the cylinders, two damping members, each of which fastens the arm adjusting-members to the cylinders at both sides of the shoe, arranged in the cylinders of both sides of the shoe, wherein the U-shaped adjusting-members of both sides of a pair of the shoes are slid and fastened at appropriate heights of the U-shaped adjusting-members to the cylinders by the clamping members in accordance with an angle of a slope, in order to almost horizontally maintain the soles of the pair of shoes, while walking transversely on the slope, so that a man can easily walk on the slope.

Also, about the shoe with a fixture for walking on a slope according to the embodiment, the cylinders may be round or angular in their sectional view. The number of the cylinders may be one or more. The lower end vicinities of the arm adjusting-members may be fixed to the bottom adjusting-member.

Further, about the shoe with a fixture for walking on a slope according to the embodiment, the clamping member may include a set screw for fastening the arm adjusting-member to the U-shaped base-member. The cylinder may include a threaded hole for being screwed by the set screw. In this case, a plurality of recesses or transversal slots for being engaged with the set screw may be arranged on the surface of the cylinder.

For arranging a plurality of cylinders, a spring projection may be installed in each of the cylinders at the same height. Further, all these spring projections may be arranged in a bar. Each arm member sliding in the cylinder may have a plurality of recesses or slots for engaging the spring projection. By drawing out all these spring projections, the arm members may be slid up or down, and adjusted at an appropriate height and fastened there by releasing all the spring projections to be engaged with the recesses or slots.

The shoe with fixtures for walking on a slope according to another embodiment may comprise the U-shaped base-member, the U-shaped adjusting-member and the damping member according to any of the shoes with the cylinders arranged in both sides of the shoe mentioned above, the U-shaped base-member, the U-shaped adjusting-member and the damping member according to any of the shoes with the fixture arranged in the heel of the shoe mentioned above, or the U-shaped base-member, the U-shaped adjusting-member and the clamping member according to any of the shoes with the fixture arranged in the toe of the shoe mentioned above.

Consequently, a man wearing a pair of the shoes according to the present invention can maintain easily and safely the natural posture suitable for walking even when he walks longitudinally or transversely on a slope, and further, in a flat place.

Also, as the fixture can be folded or retracted, a man can walk in a flat place wearing a pair of the shoes with the fixture according to the present invention without carrying the fixture. Therefore, the present invention can make the shoes for climbing a mountain and also walking in a flat place more convenient than can the shoe according to the prior art.

BRIEF DESCRIPTION OF THE DRAWINGS

FIG. 1(*b*) shows a bottom view of the mountaineering shoe 1.

FIG. 2(*b*) shows a side view of the U-shaped sliding-member 14 combined with a base member 15 of the first embodiment of the present invention.

FIG. 3(*b*) shows a fragmentary sectional view for illustrating how to install the U-shaped fixtures (13, 14, 15) in the mountaineering shoe 1.

FIG. 5(*b*) shows a rear-view of the mountaineering shoe 2.

FIG. 6(*b*) shows a rear-view of the mountaineering shoe 2.

FIG. 7(*b*) shows a rear-view of the mountaineering shoe 2.

FIG. 8(*b*) shows a bottom view of the mountaineering shoe 3.

DETAILED DESCRIPTION OF THE PREFERRED EMBODIMENTS

The embodiments of the present invention are now explained in detail, using mountaineering shoes as examples, by referring to FIGS. 1–13, as follows.

To begin with, mountaineering shoes, the heel portions of which can be lifted to ascend a slope, are described (about the first and second embodiments).

Referring to FIGS. 1–4, the first embodiment is illustrated as follows.

Figure 1:
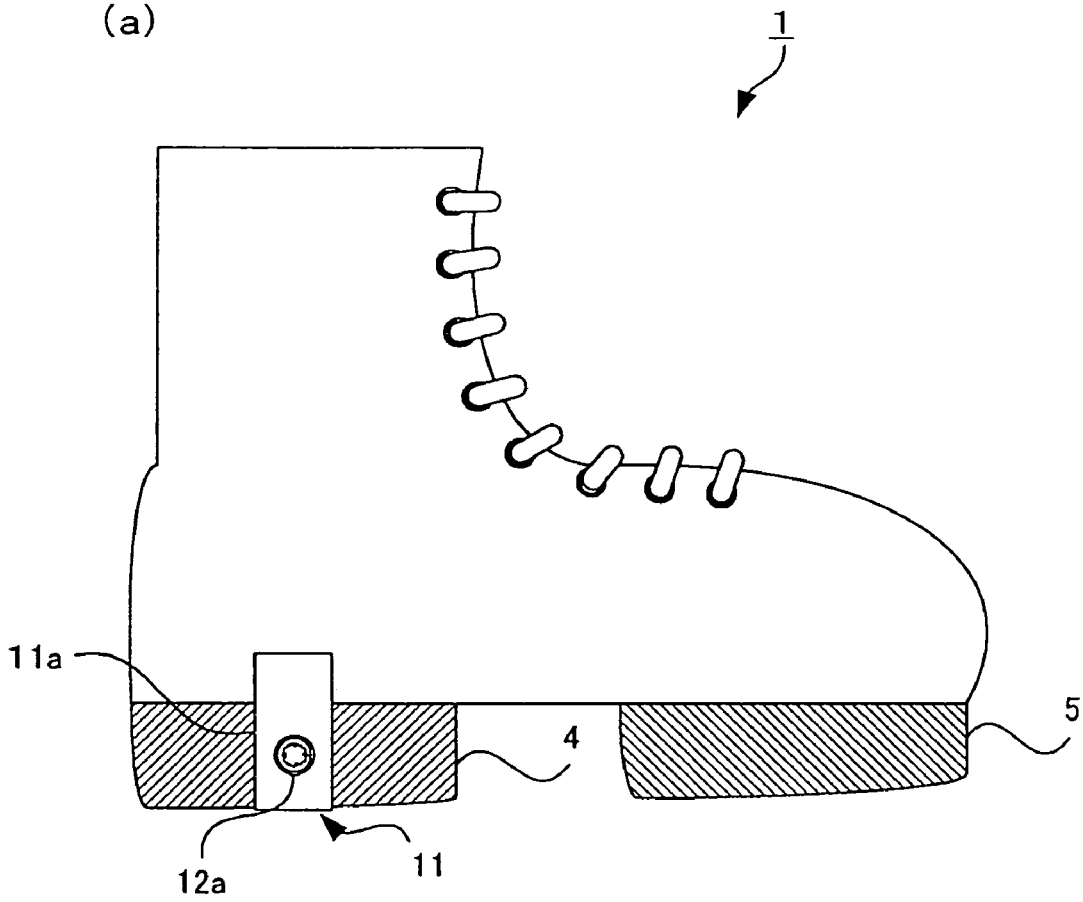
FIG. 1(*a*) shows an elevational view of a mountaineering shoe 1, from which the U-shaped fixtures (13, 14, 15) are removed, of the first embodiment of the present invention.
Figure 1:
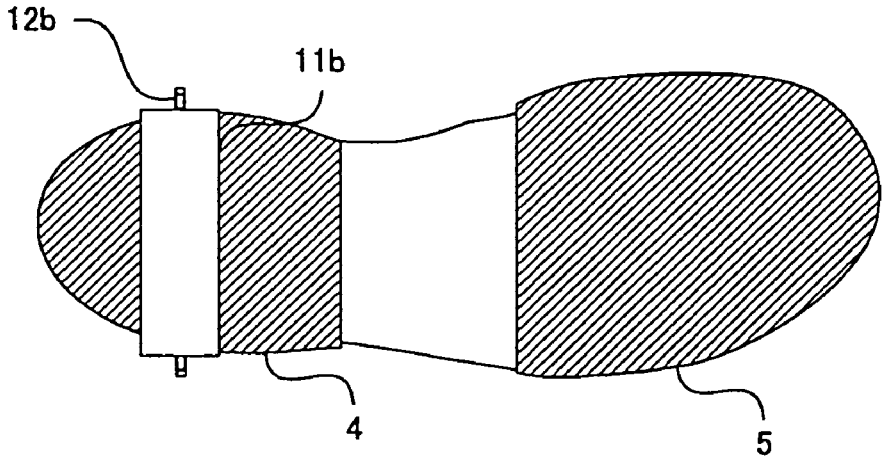
Figure 2:
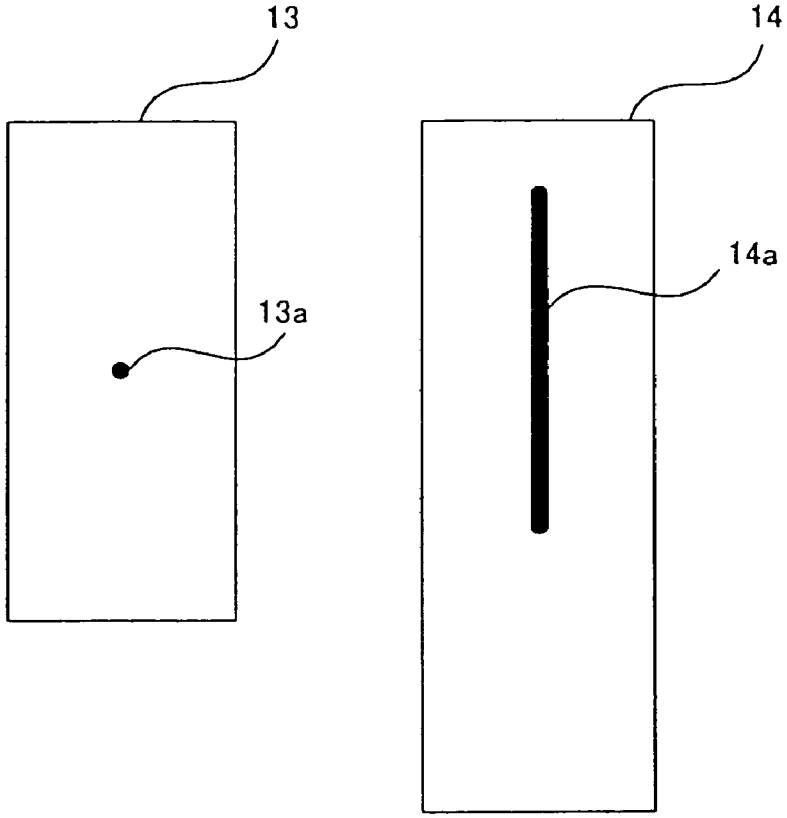
FIG. 2(*a*) shows an elevational view of a fixing member 13 and a U-shaped sliding-member 14 of the first embodiment of the present invention.
Figure 2:
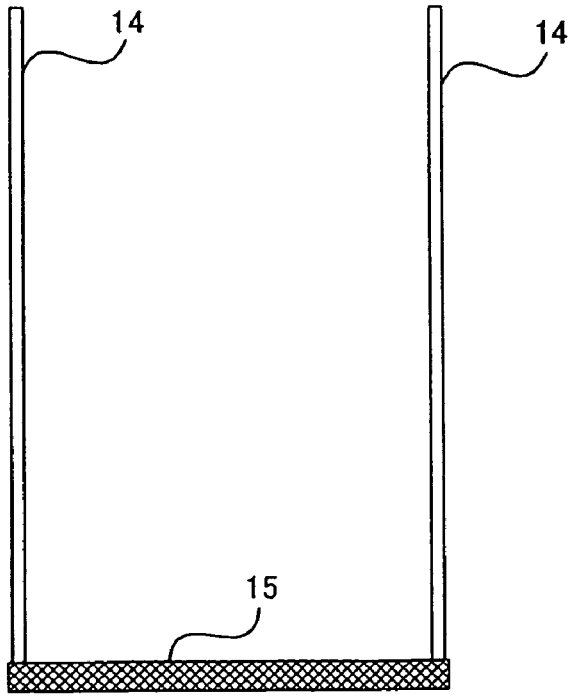
Figure 3:
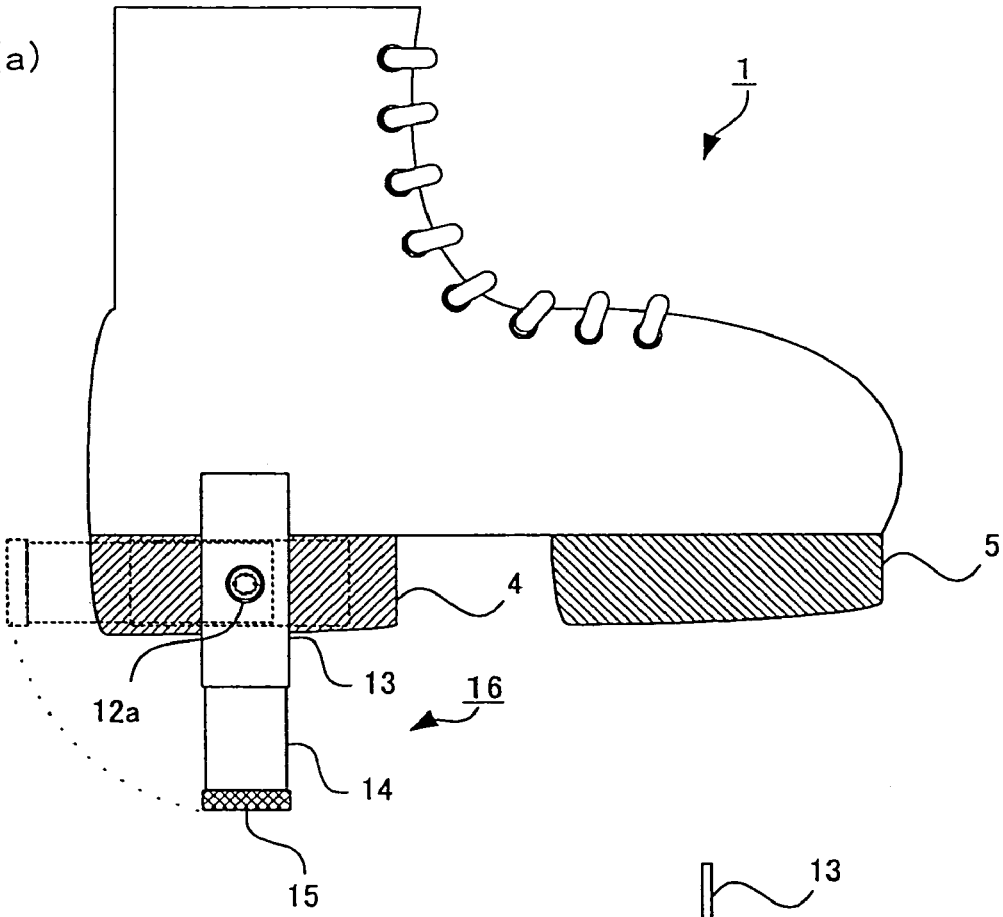
FIG. 3(*a*) shows the operating range of the fixing member 13, the sliding member 14 and the base member 15 installed in the mountaineering shoe 1 of the first embodiment of the present invention.
Figure 3:
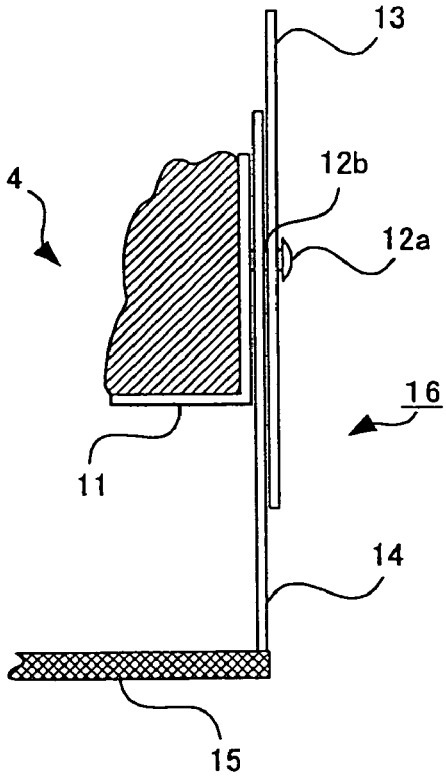

FIGS. 1–3 show an elevational view of the first embodiment of the present invention. In these drawings, mountaineering shoes 1 have a metal base-plate 11, two internal threads 12*a*, two externally threaded shafts 12*b* screwed into said internal threads 12*a*, two clamping-members 13, two sliding members 14, and a bottom member 15.

The U-shaped base plate 11 is made from a narrow and long metal plate, as shown in FIGS. 1(*a*) and (*b*). The base plate 11 is fitted and fastened almost in the middle of the heel portion 4 along the contour of the sole and the side of the shoe by means of threaded fasteners, etc., arranged at appropriate positions. This base plate may be made from plastic materials or porcelain material, etc.

The U-shaped base plate 11 comprises arms 11*a* and a base member 11*b*, which is in contact with the heel 4, as shown in FIGS. 1(*a*) and (*b*). An externally threaded pin 12*b* for fitting a set nut 12*a* is fixed almost in the middle of each arm 11*a*, and projected therefrom.

The externally threaded pins (set bolt) 12*b* fixed to the two arms 11*a* of the base plate 11 may be arranged as one shaft which goes through the heel 4. Such a shaft 12*b* is not only fixed firmly to the base plate 11, but also to the heel 4. Therefore, the mountaineering shoe 1 can be used in a stable condition.

FIGS. 2(*a*) and (*b*) show structures of a clamping-member 13, a sliding member 14 and a bottom member 15.

In FIG. 2(*a*), two clamping-members 13, each of which is made from a rectangular metal plate, are arranged in contact with both sides of the base-plate 11. Each clamping-member 13 has a hole 13*a* almost in the middle of the member to be fitted in the set bolt 12*b*. But, the clamping members 13 do not have to always be a rectangular metal plate. The member may be a round plate. The size of the member is not so important. The clamping-members 13 may not be used in some conditions.

Though the sliding member 14 is illustrated as a rectangular metal plate, and shown in FIG. 2(*a*), the shape of the sliding member 14 is also not limited to such a rectangular metal plate. The sliding member 14 is longer than the clamping member 13, to slide in a wide range. Further, a slit 14*a* for longitudinally guiding the sliding member 14 is arranged almost in the middle of the sliding member 14.

Also, the clamping member 13 may have rims (not shown in the drawings) in both sides of the member 13, extending longitudinally, for keeping the sliding member 14 slidable. In this case, as the sliding member 14 is held firmly, the mountaineering shoes 1 are used safely.

A small projection (not shown in the drawings) may be arranged apart from the hole 13*a* in the clamping member 13. Then, another oblong hole or slot (not shown in the drawings) for fitting said small projection may be arranged in parallel to the oblong hole or slot 14*a* in the sliding member 14 in order to ensure the sliding member's operation.

As shown in FIG. 2(*b*), two sliding members 14 and the bottom member 15 are connected to each other to form a U-shape. Also, the bottom member 15 may be fixed at a position higher than the lower end of the sliding members 14. These U-shaped members need to be made from materials having sufficient strength to support a person's weight in mountaineering.

A U-shaped member 16 comprises two clamping members 13, two sliding members 14, and one bottom member 15 (see FIG. 3(*b*)).

FIG. 3(*a*) shows the operating range of the U-shaped adjusting member 16 of the mountaineering shoe 1 of the first embodiment of the present invention.

As shown in FIG. 3(*a*), the U-shaped member 16 rotates backward around the shaft 12*b* about 90 degrees, from almost a vertical position to almost a horizontal position.

As shown in FIG. 2(*a*), the clamping member 13 can rotate, but cannot slide. On the contrary, the sliding member 14 can rotate and also slide.

FIG. 3(*b*) shows a fragmentary sectional view for illustrating a connecting part of the U-shaped member 16 and members (11, 13, 14, 15) of the mountaineering shoe 1.

In said connecting part, the externally threaded shaft or set bolt 12*b* fixed to the base member 11 is fitted into the slit 14*a*, the hole 13*a*, and the set nut 12*a* to be screwed on the shaft or bolt 12*b*. The sliding member 14 and clamping member 13 are locked to the arm portion 11*a* of the base member 11 by tightening the set nut 12*a* screwed into the set bolt 12*b*.

Also, the U-shaped member 16 can be rotated backward about 90 degrees from a vertical position to a horizontal position by loosening the set nut 12*a*, as shown in FIG. 3(*a*).

When the U-shaped member 16 is rotated vertically, and then the sliding members 14 are lowered and locked to the lowest position, the heel of the mountaineering shoe 1 is at the highest position. When the U-shaped member 16 is rotated horizontally, the height of the heel 4 is arranged in the lowest position, which is equal to the heel 4 itself. Therefore, if the U-shaped members 16 of a pair of the mountaineering shoes 1 is kept horizontal, it is no obstacle for walking on a flat place using said mountaineering shoes 1.

To rotate the U-shaped adjusting member 16, while it is fixed to the mountaineering shoe 1, backward and horizontally so that the bottom member 15 does not collide with the heel 4, the radius of the bottom member 15 can gyrate or the length from the shaft 12*b* to the bottom member 15 must be made sufficiently longer than the length from the shaft 12*b* to the rear end of the heel 4 by regulating the position of the sliding member 14 (see FIG. 3(*a*)).

Next, how to regulate the height of the heel is explained as follows.

The set nuts 12*a* in both sides for fastening the clamping member 13 and the sliding member 14 to the base member 11 are loosened to begin with. Then, the U-shaped adjusting member 16 is rotated to a predetermined position. The height of the heel portion 4 is regulated to a suitable value. The clamping member 13 and the sliding member 14 are fastened to the base member 11 by tightening the set nuts 12*a*.

For a slope with a big angle of inclination, the U-shaped adjusting member 16 is rotated vertically by loosening the set nuts 12*a*, and the sliding members 14 are pushed down and adjusted to a suitable height. The U-shaped base member 11 and the sliding members 14 are fastened to the clamping member 13 by tightening the set nuts 12*a*.

Therefore, the height of the heel portion 4 of the mountaineering shoes 1 can be adjusted by using the U-shaped member 16 to keep the natural posture.

Also, though the set nut 12*a* and bolt 12*b* are adopted for fastening the U-shaped adjusting member 16 to the base member 11 in the above embodiments, any fastening means can be used, if it surely fastens the U-shaped adjusting member 16 to the base member 11.

Figure 4:
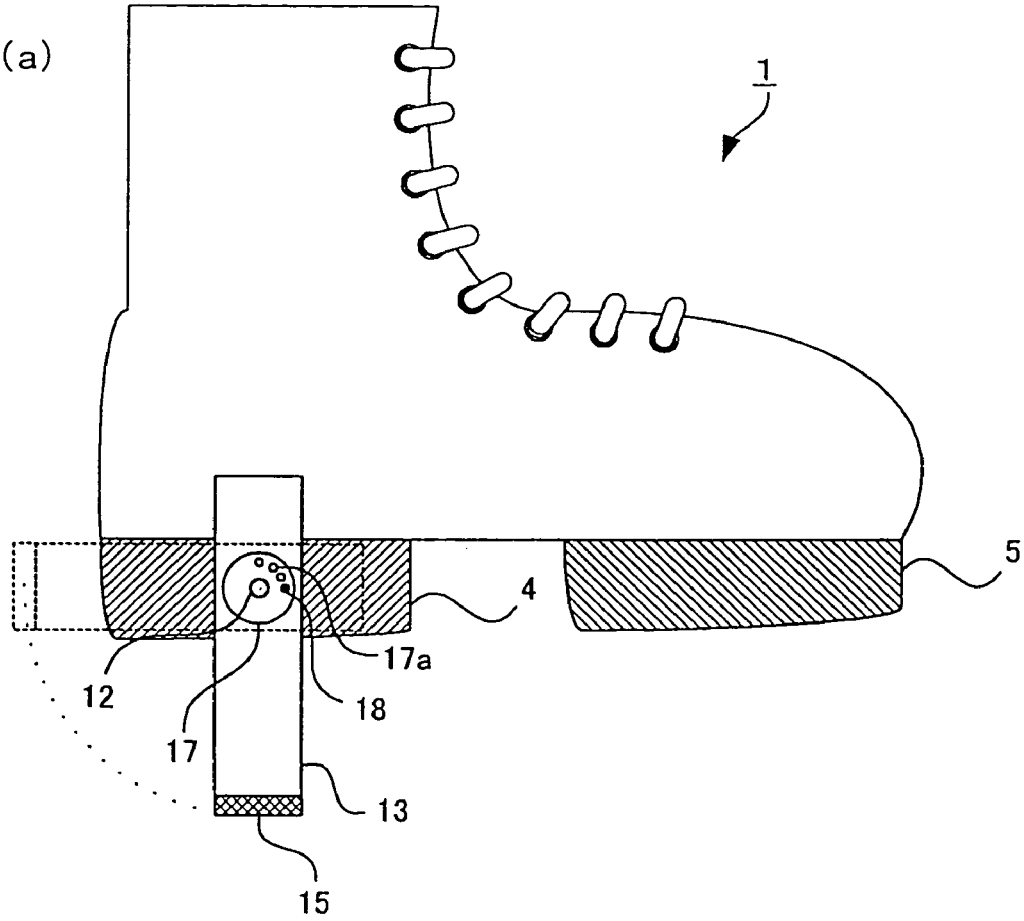
FIG. 4(*a*) shows the operating range of the U-shaped fixtures (13, 15, 17, 18) for the mountaineering shoe 1 of the first embodiment of the present invention, FIG. 4(*b*) shows a fragmentary sectional view for illustrating how to install the U-shaped fixtures (13, 15, 17 and 18) in the mountaineering shoe 1.
Figure 4:
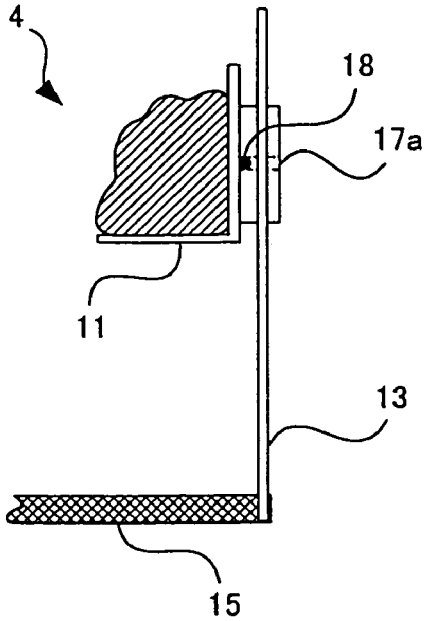

FIG. 4 shows an alternative of the fixture of the first embodiment. This embodiment comprises a clamping member 13, a U-shaped base member 11, a ring 17, cyclic through holes 17*a*, and a projection 18.

The central portion of the ring member 17 is fixed to the shaft 12 of the base member 11 so that the ring member 17 can be rotated within a predetermined angle range (90 degrees in FIG. 4(*a*). A plurality of through holes 17*a* are arranged at a constant angle on a circle of the ring 17. The projection 18 is engaged in one of these through holes 17*a*.

The projection 18, which is arranged toward the toe side and apart from the shaft 12, as shown in FIG. 4(*a*), is projected outward from the base member 11 by a compressive force of a spring.

According to the above variation of the first embodiment, the procedure for adjusting the height of the heel portion 4 is explained as follows. The projection 18 is disengaged from one of the through holes 17*a* by pushing the projection 18 inside the base member 11 from said through hole 17*a*. When the height of the heel portion 4 corresponds to the angle of inclination of the slope by rotating the clamping member 13 together with the ring 17, the projection 18, projecting from the inside of the base member 11, is engaged in an appropriate through hole 17*a* and then the clamping member 13, together with the ring 17, is fixed surely to the base member 11 to achieve the appropriate height of the heel portion 4, i.e., corresponding to the angle of inclination of the slope.

As mentioned above, the variation of the fixture of the first embodiment adopts the ring 17 and the projection 18 of a spring-type instead of the set nut 12*a* and bolt 12*b*, to fix the U-shaped adjusting member 16 to the base member 11. Therefore, according to this variation, it is possible to adjust the height of the heels of mountaineering shoes in a shorter time than with the embodiment adopting the set nut 12*a* and bolt 12*b*, and to improve the convenience of users.

This variation may comprise a sliding member like the sliding member 14 shown in FIG. 3, instead of the clamping member 13 shown in FIG. 4(*b*). Using this type of sliding member, the height of the heel 4 can be adjusted more easily by rotating and sliding the sliding member than by using that of this variation.

Figure 13:
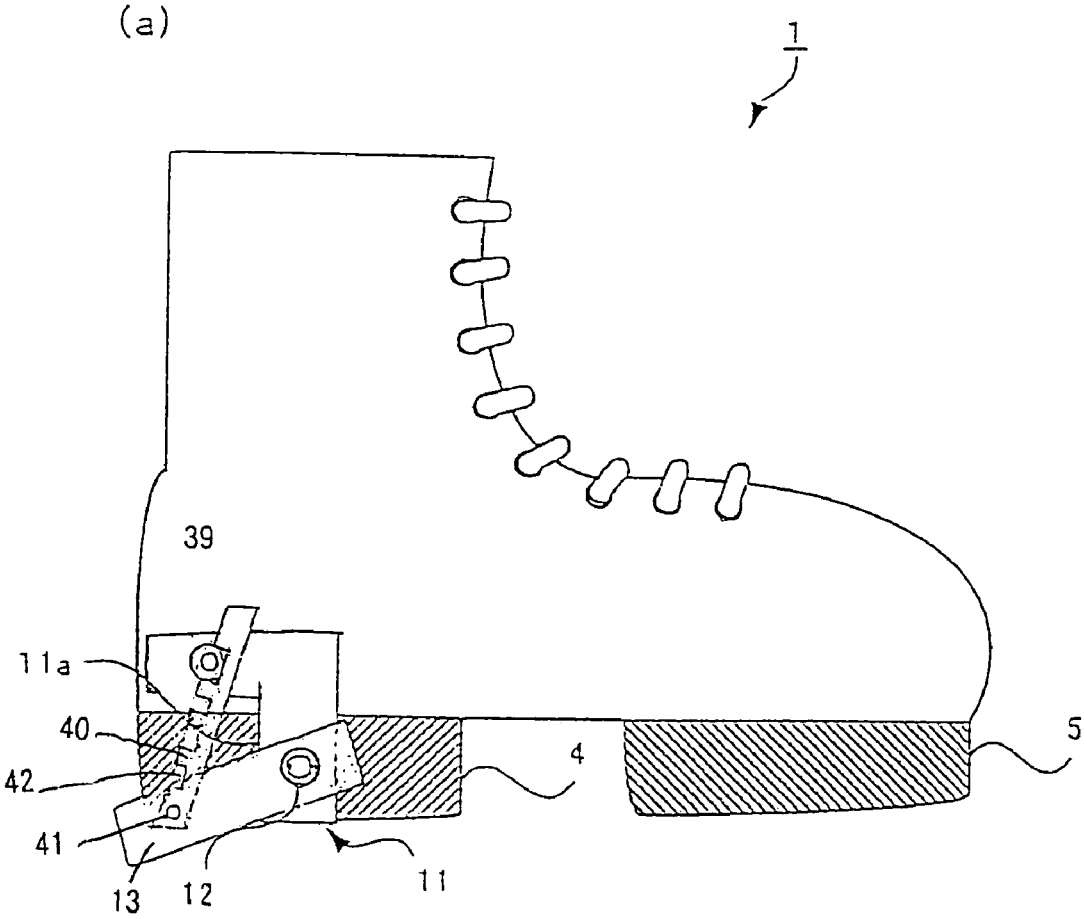
FIG. 13 shows an elevational view of a mountaineering shoe 11, for ascending a slope, of the fourth embodiment of the present invention.
Figure 13:
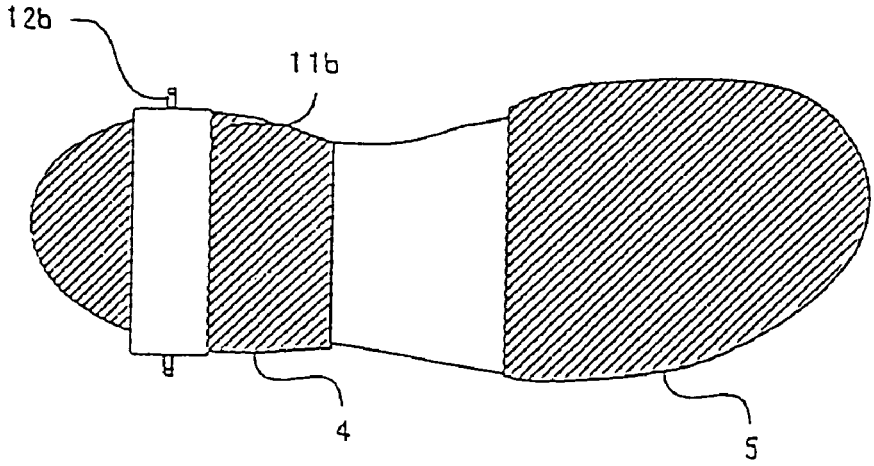

Further, FIG. 13 shows another variation of the fixture of the first embodiment, as the fifth embodiment, as illustrated below. The upper end of the base member 11 is bent rearward at a right angle, as an arm plate. The second shaft 39, like the first shaft 12, is arranged in the arm plate. The clamping member 13 or the sliding member 14 of the fixture 16 are supported by diagonal-bracing members 40. One end of each diagonal bracing member 40 is rotatable about a pivot arranged at an end 41 of the member 40. A plurality of notches 42 are arranged in one side of the member 40. One of the notches 42 is engaged with the second shaft 39 to support the clamping and adjusting members 13, 14.

Figure 8:
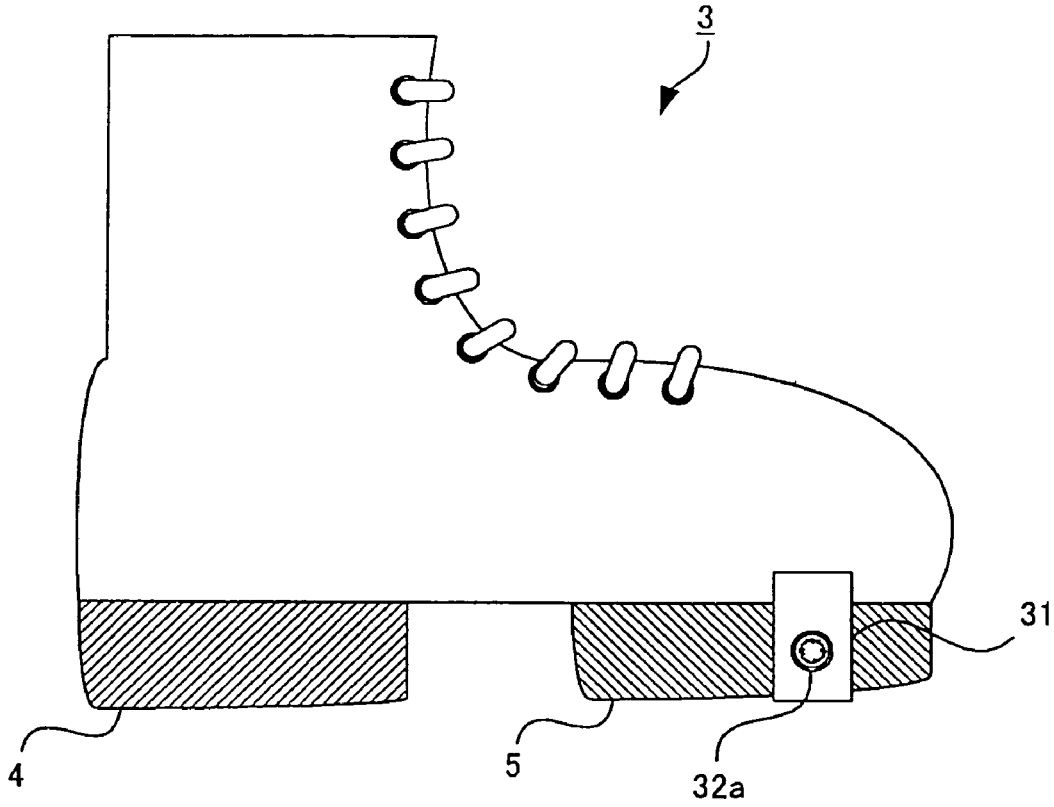
FIG. 8(*a*) shows an elevational view of a mountaineering shoe 3, from which a U-shaped fixture 36 is removed, for descending a slope, of the third embodiment of the present invention.
Figure 8:
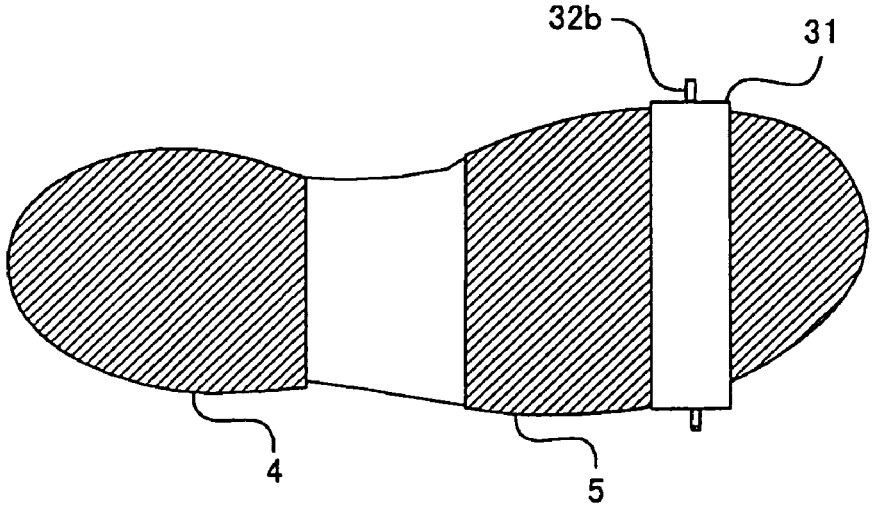
Figure 9:
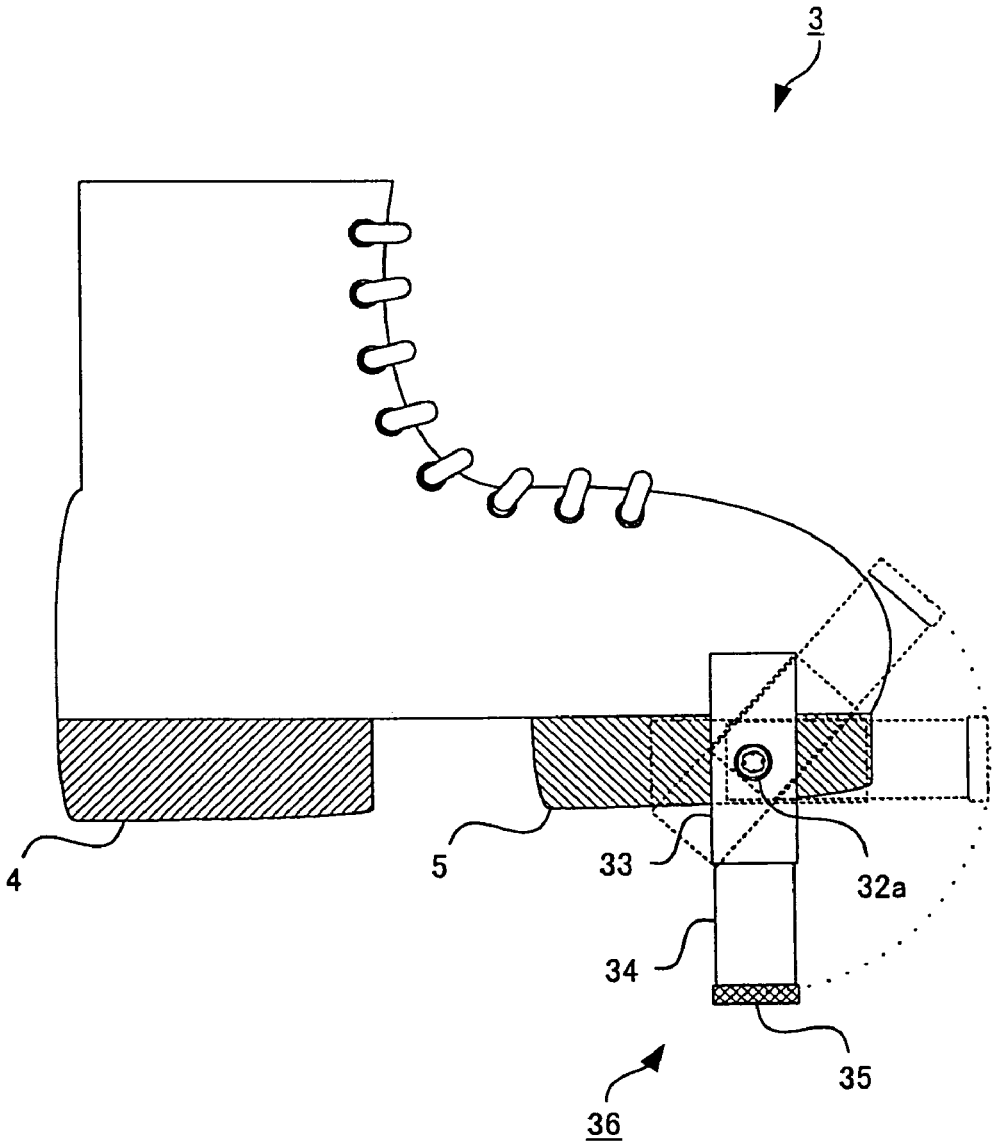
FIG. 9 shows the operating range of a U-shaped fixing-member 36 installed in the mountaineering shoe 3 for descending a slope of the third embodiment of the present invention.
Figure 10:
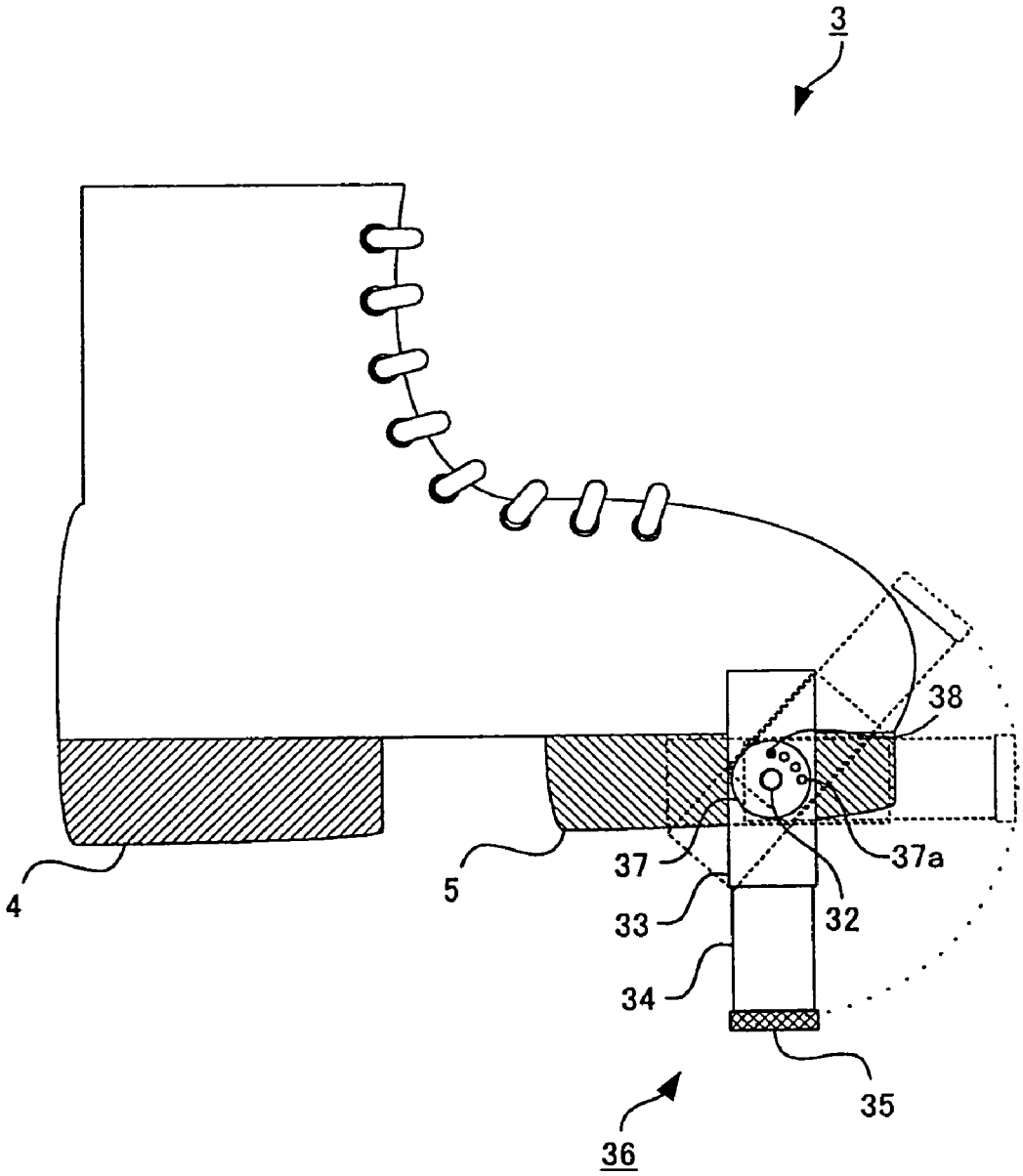
FIG. 10 shows the operating range of another fixing-member 36 installed in the mountaineering shoe 3 of the third embodiment of the present invention.

The fixture mentioned above that comprises such a diagonal bracing member 40 can be adapted to the front part of the mountaineering shoe 3 as shown in FIGS. 8–10. The width of the diagonal bracing member 40 may be less than the width of the member 11 or 13.

Figure 5:
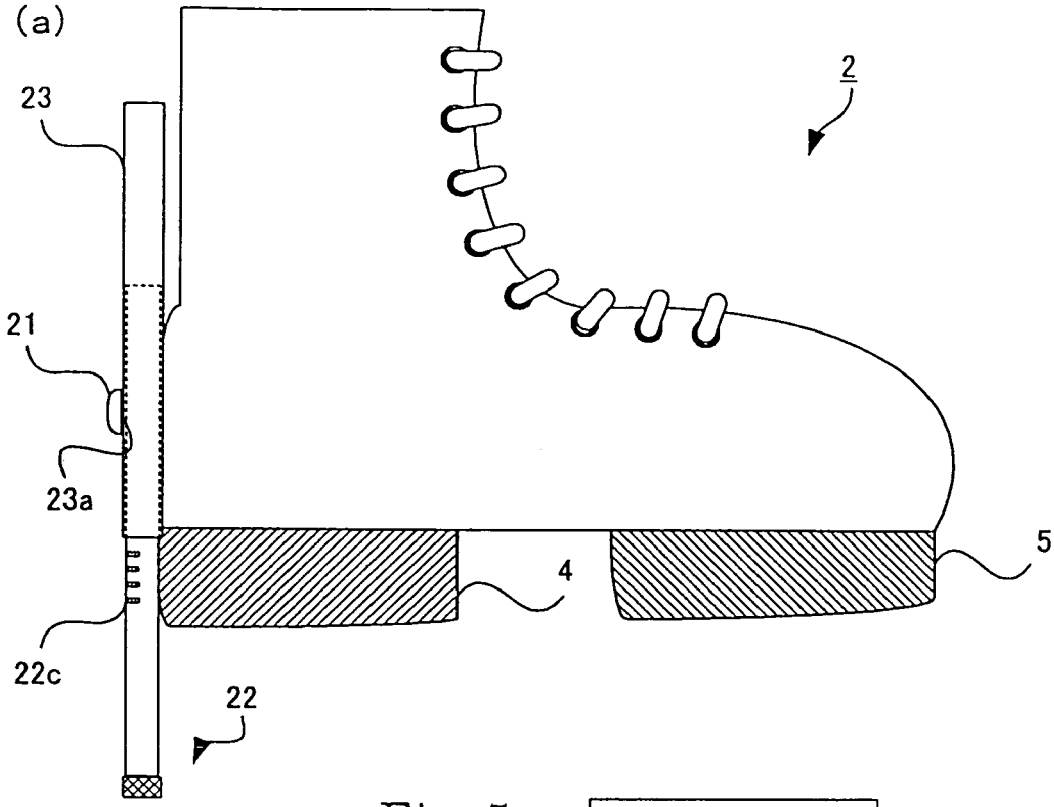
FIG. 5(*a*) shows an elevational view of a mountaineering shoe 2 equipped with a U-shaped fixture 22 for ascending a slope of the second embodiment of the present invention.
Figure 5:
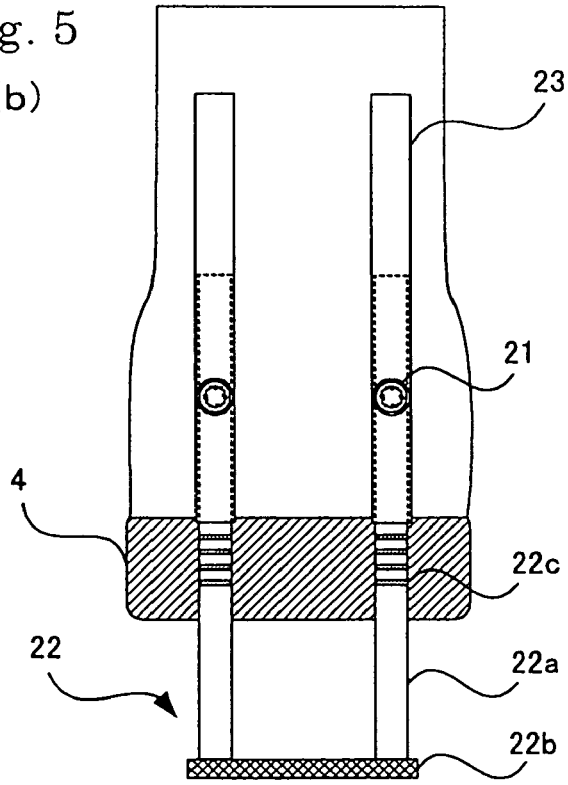
Figure 6:
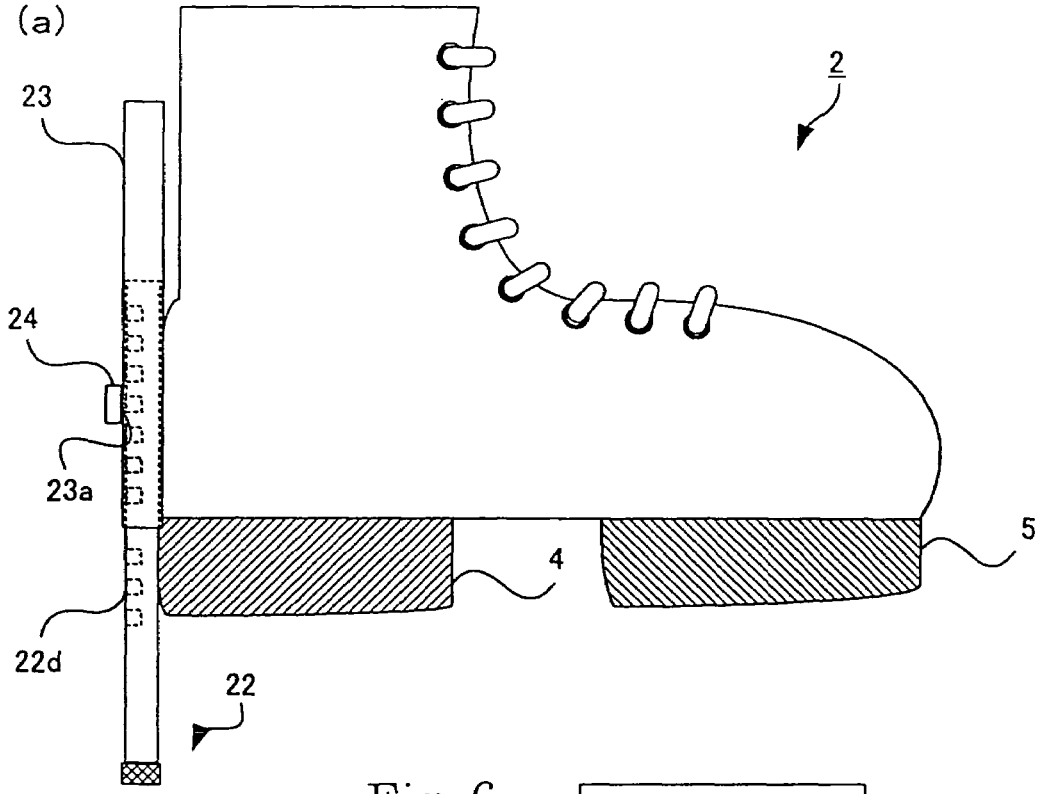
FIG. 6(*a*) shows an elevational view of a mountaineering shoe 2 equipped with another U-shaped fixture 22 for ascending a slope of the second embodiment of the present invention.
Figure 6:
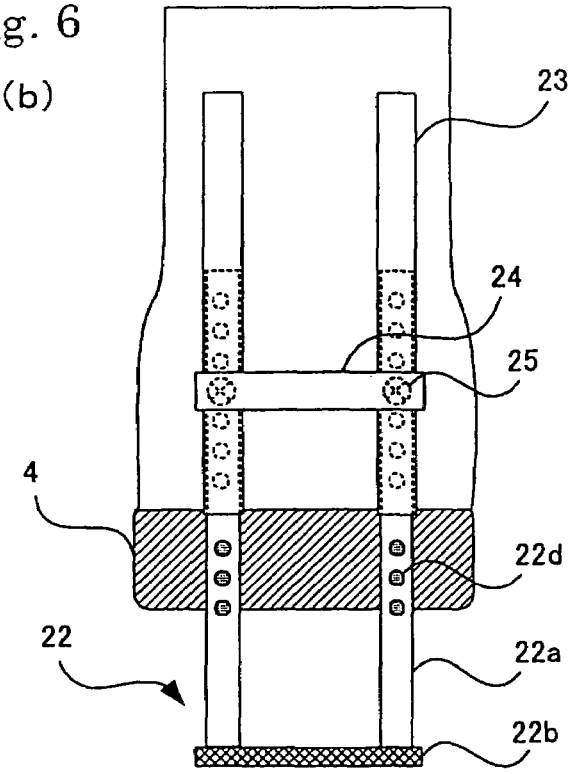
Figure 7:
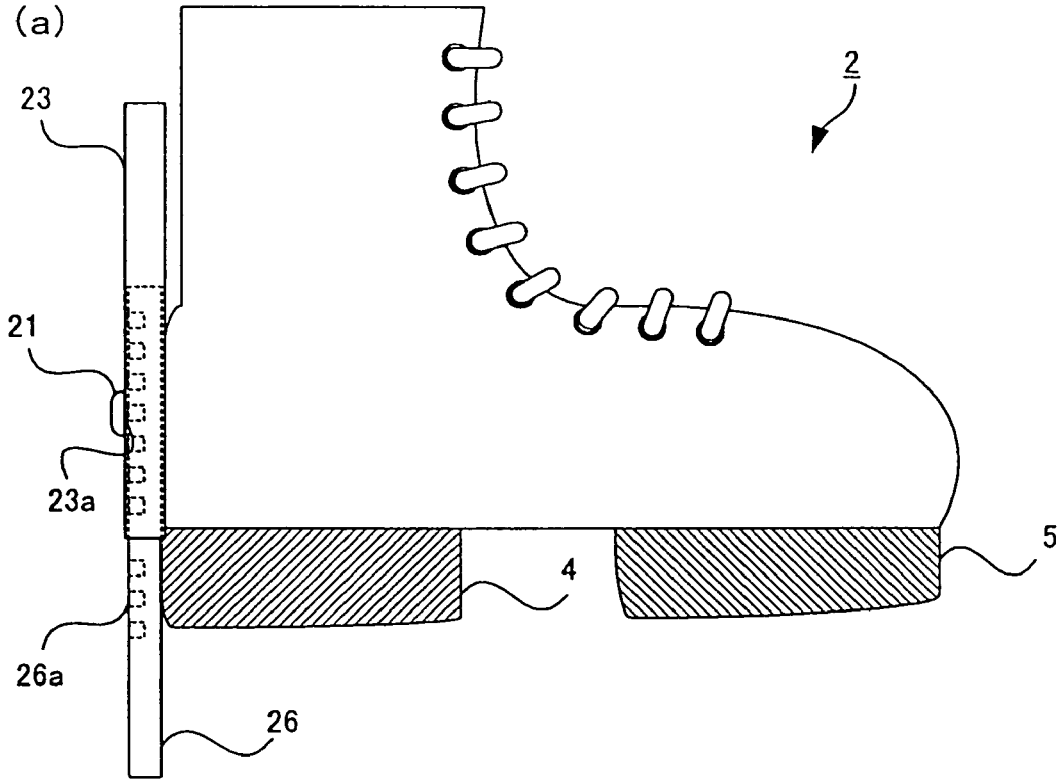
FIG. 7(*a*) shows an elevational view of the mountaineering shoe 2 equipped with another fixture 26, for ascending a slope, of the second embodiment of the present invention.
Figure 7:
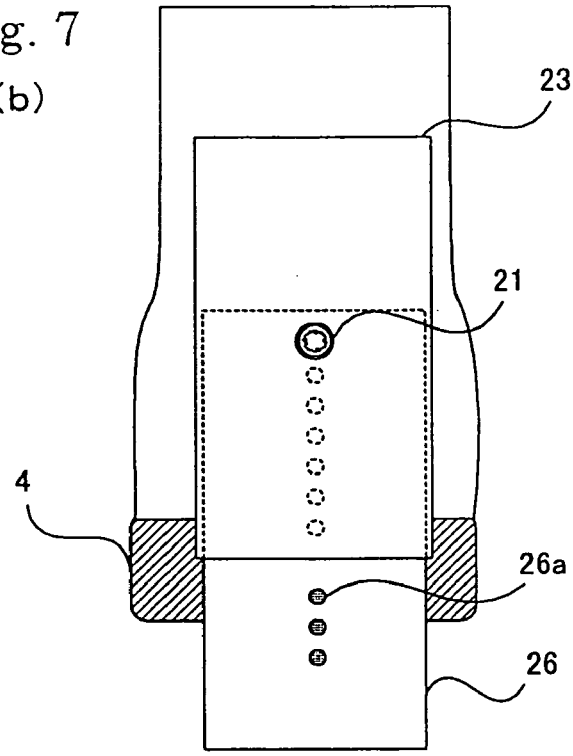

Referring to FIGS. 5–7, the second embodiment is illustrated in detail as follows. FIGS. 5(*a*) and (*b*) show the fixture for walking of the second embodiment of the present invention. This mountaineering shoe 2 comprises two set screws 21, one U-shaped member 22, and two cylinders 23.

The U-shaped member 22 includes two vertical arm members 22*a* and a base member 22*b* fixed to both bottom ends of said vertical arm members 22*a*. The number of vertical arm members corresponds to that of the cylinder members 23, illustrated below, and may be more than two. The cylinder members 23 are arranged apart from each other at appropriate intervals. The vertical arm member 22*a* needs to slide in the cylinder member 23. Therefore, for example, an internal diameter of the cylinder member 23 is slightly larger than the external diameter of the vertical arm member 22*a*. But, the cross-sectional shapes of these members do not always need to be circular or rectangular.

Two cylinders 23 are fixed almost vertically for the sole surface (i.e. the ground) at constant intervals to the back of the shoe 2 by more than one set screw (the connecting section is not shown in the drawing). The cylinders 23 are arranged in parallel so that the parallel and vertical arm members 22*a* can slide in the cylinders 23.

Each of the cylinders 23 is hollow and arranged with a hole 23*a* at an appropriate height (preferably less than that of the center of the cylinder 23) for being screwed at right angles against the back of the mountaineering shoe by the set screw 21 (refer to FIG. 5(*a*). The hole 23*a* is threaded for being screwed by the set screw 21.

The vertical arm members 22*a* of the U-shaped member 22 are locked at an appropriate position of the cylinders 23 by screwing the set screw into the threaded hole 23*a* and tightening the set screw to the arm member 22*a*. The cylinder 23 may be made from any material with the desired strength, other than metal.

Further, a plurality of transverse slots or recesses 22*c* for engaging the tip of the set screw 21 are preferably arranged at constant intervals on the surfaces of the vertical arm members 22*a* in order to surely lock the U-shaped member 22 to the cylinder 23 by a set screw 21, as shown in FIGS. 5(*a*) and (*b*).

Also, like in the first embodiment, when the U-shaped member 22 is inserted most deeply into the cylinder 23, the bottom member 22*b* of the U-shaped member 22 can be adjusted so as not to contact the ground, so that it is not troublesome for walking on a flat place, while each instrument, as mentioned above, is installed.

The second embodiment differs from the first embodiment in that the arm members 22*a* of the U-shaped member 22 slide up and down in the cylinders 23 and are locked to said cylinders 23 by screwing the set screw 21 into the threaded hole 23*a* and tightening the set screw 21 to the slot or recess 22*c*.

Next, the procedure for adjusting the height of the heel 4 of the shoe 2 is illustrated as follows. Referring to FIG. 5, two set screws 21, fastening the U-shaped member 22 to the cylinder 23, are loosened. The two vertical arm members 22*a* of the U-shaped member 22 are slid to adjust the height of the heel 4. The U-shaped member 22 is locked to the cylinder 23 at an appropriate height of the heel 4 by tightening the set screws 21.

In addition, according to the second embodiment, the holes 23*a* should be positioned only within the range for arranging the slots or recesses 22*c*, in order to firmly maintain the height of the heel 4 by engaging the set screw 21 in one of the slots or recesses 22*c*.

Consequently, a man can maintain his natural posture by adjusting the height of the heel 4 of the mountaineering shoes 2, using the U-shaped member 22, etc., while he walks while wearing a pair of the mountaineering shoes 2 installed with the fixture for a slope, according to this embodiment.

FIGS. 6(*a*) and (*b*) show another variation of the fixture of the mountaineering shoe 2 of the second embodiment. The mountaineering shoe 2 comprises one U-shaped member 22, two cylinders 22*a*, one bar 24, and two projections of a spring-type 25. Though the fixture of this embodiment is illustrated, a redundant description is omitted. The configuration of the cylinder 23 may be either a circular- or angular-type. Also, the type of the cylinder 23 is not limited to the above-mentioned type, or the previous embodiments.

A small hole 23*a* is arranged in each of the cylinders 23. A plurality of recesses 22*d* are arranged at constant intervals in each of the cylinders 23. The recesses 22*d* are engaged via the small hole 23*a* in a spring projection, which is backed by a spring, as illustrated below. Therefore, the height of the U-shaped member 22 is adjusted and the member 22 is locked. That is to say, the height of the heel 4 can be kept at a desired value. Also, what can be engaged in the spring projection 25 may be the slots 22*c* (as mentioned above).

According to this embodiment, as the spring projection 25 is not a set screw, this small hole 23*a* does not need to be threaded. Therefore, it is advantageous in that the cylinder 23 can be manufactured more easily than other variations of the second embodiment.

The spring projections 25, engaged in the recesses 22*d*, are arranged in correspondence with the number of cylinders 23. All of them are fitted in one bar 24. Therefore, the bar 24 is pressed by all of the spring projections 25.

Next, the procedure for adjusting the height of the heel 4 of the shoe 2 is illustrated as follows. By drawing out the bar 24 toward the outside of the cylinder 23, the connection between the recess 22*d* and the spring projection 25 is released and then the U-shaped member 22 is slid up or down to adjust the height of the heel 4 in accordance with the angle of the slope. By stopping the drawing of the bar 25 to maintain the height, the spring projection 25 is engaged in the appropriate recess 22*d*. The U-shaped member 22 is simultaneously locked there. Accordingly, the height of the heel 4 is set at the appropriate position.

As mentioned above, according to the variation of the fixture of the second embodiment, the spring projection 25 is used instead of the set screw 21 to fix the U-shaped member 22 in the cylinder 23 at a desired position. Therefore, as the spring projection 25 can fix the U-shaped member 22 to the cylinder 23 more easily than can the set screw 21 screwed into the slot 22*c* of the U-shaped member 22, this variation can improve the convenience of the mountaineering shoes 2 with the fixture for walking on a slope to quickly adjust the height of the heel 4.

FIGS. 7(*a*) and (*b*) show another variation of the U-shaped member 22 of the mountaineering shoe 2 of the second embodiment of the present invention. The mountaineering shoe 2 comprises one set screw 21, one cylinder 23, and one sliding plate 26. This mountaineering shoe 2, shown in FIGS. 7(*a*) and (*b*), differs from other mountaineering shoe shown FIGS. 5 or 6 in using one cylinder 23 and one sliding plate 26, without the bottom member 22*b*.

The cylinder 23 is rectangular. In it the sliding plate 26 is arranged to be slidable. Like the cylinders 23 shown in FIGS. 5 and 6, the cylinder 23 shown in FIGS. 7(*a*) and (*b*) is arranged on the back of the mountaineering shoe 2, and has a threaded hole 23*a*, in which a set screw 21 is screwed to lock the sliding plate 26 to the cylinder 23, at an appropriate height (preferably, below the center of the cylinder 23). Also, this cylinder may be made from any material which has an appropriate strength, except metal.

The sliding plate 26 is a rectangular pillar and has recesses or slots 26*a*, for engaging the set screw 21, at constant intervals, as shown in FIGS. 7(*a*) and (*b*). This sliding plate may also be made from any material which has an appropriate strength. But, as the metal fixture makes the back of the shoe heavy and creates problems in walking, the fixture is preferably made from a lightweight and reinforced plastic material.

Further, the fixture of this embodiment does not need a bottom member 22*b*, which uses one siding plate 26, while the fixtures shown in FIGS. 5 and 6 use more than one vertical arm member 22*a*. Therefore, it is advantageous in that this variation can reduce the number of components and simplify the manufacture of the fixture for mountaineering, compared with other variations.

Also, though FIGS. 7(*a*) and (*b*) show one set screw for fastening the sliding plate 26, a plurality of set screws and small holes may be installed at constant intervals, vertically or horizontally. Instead of the set screws, the bar having the spring projections as shown in FIG. 6 may be adopted. Of course, it goes without saying that a plurality of set screws more firmly fasten the sliding plate 26 to the cylinder 23 than does one set screw.

Next, as the procedure for adjusting the height of the heel 4 of this variation is similar to the procedures of the variations shown in FIGS. 5 and 6, its description is abbreviated here to avoid repeating it.

Subsequently, a mountaineering shoe with a fixture to adjust the height of the shoe's toe for descending a slope is described as follows.

FIGS. 8–10 show the structures of the mountaineering shoes 3 with fixtures for walking on a slope according to the third embodiment of the present invention. The mountaineering shoes 3 comprise a base member 31, two female set nuts or threaded holes 32*a*, two clamping members 33, two sliding members 34, and a bottom member 35.

As the structures of the two clamping members 33, the two sliding members 34, and the bottom member 35 are similar to those of the first embodiment, the structures are illustrated using FIG. 2 of the first embodiment. In this case, according to this embodiment, the reference numerals are replaced as follows: the clamping member 13 with 33, the threaded hole 13*a* with 33*a*, the sliding member 14 with 34, and the hole for sliding 14*a* with 34*a*.

The structure of the base member 31 is similar to that of the base member or plate 11. Referring to FIGS. 8(*a*) and (*b*), the base member 31 is U-shaped and fitted to the toe part 5 of the shoe 3 between the middle and the tip of the toe part 5 of the shoe 3 along the sole and the side of the shoe 3, and fixed to the sole in arbitrary locuses by set screws.

Two externally threaded shafts or two set screws 32*b* may be formed as one threaded shaft like in the first embodiment. As this threaded shaft goes through the toe part 5, the shaft is firmly fixed to the base member 31 and the toe part of the shoe 3. Therefore, the mountaineering shoes are used safely.

The structure of the clamping member 33 is similar to that of the clamping member 13 of the first embodiment (see FIG. 2(*a*)). A threaded hole 33*a* is to be arranged in the middle of the clamping member 33.

The structure of the sliding member 34 is similar to that of the sliding member 14. A lengthwise slot 34*a* is to be arranged in the middle of the sliding member 34 (see FIGS. 2(*a*) and (*b*).

Like in the first embodiment, the clamping member 33 may have parallel rims, which hold the sliding member 34, at both sides of the clamping member 33 (not shown in the drawings). In this case, as the sliding member 34 is firmly held by the parallel rims, the mountaineering shoes 3 are used safely.

The bottom member 35 is fixed to each end of the sliding members 34 substantially at right angles.

FIG. 9 shows the operating range of the fixture 36, which is installed in the mountaineering shoe 3, comprising the clamping member 33, the sliding member 34, and the bottom member 35.

The fixture 36 is formed into a shape like a U. The fixture 36 can be rotated over 90 degrees around the threaded shaft 32*b* toward the tip of the shoe 3 from a position almost perpendicular to the surface of the sole or the ground to another position at the level of or above the toe by loosening the set nuts 32*a* for fastening the clamping member 33 and the sliding member 34 to the base member 31.

When the U-shaped fixture 36 is positioned horizontally or above the toe, the height of the toe of the shoe 3 becomes at its lowest position. Then, the U-shaped fixture 36 is fixed to the base member 31 by tightening or screwing the set nuts 32*a* into the threaded shaft 32*b* and kept in the position equal to or above the level of the tip of the sole. Therefore, the mountaineering shoes are used safely for walking on a flat place.

According to this embodiment, and like in the first embodiment, it is possible to adjust the height of the toe 5 within a wide range by the U-shaped fixture 36 rotating to a desired angle or to a vertical position and, additionally, by the sliding member 34 sliding to its lowest point at the vertical position, particularly for a steep slope. The U-shaped fixture 36 is fixed at the desired position to the base member 31 by screwing the set nuts 32*a* into the threaded shaft 32*b*. Consequently, the height of the toe part 5 can be adjusted in accordance with the angle of a slope.

FIG. 10 shows another variation of the fixture 36 of the mountaineering shoe 3 of the third embodiment of the present invention. The mountaineering shoe 3 comprises a base member 31 (not shown in the drawing), two shafts 32, two sliding members 34, a bottom member 35, two rings 37, a plurality of through holes (arranged on a circle of the ring 37) 37*a* and a spring projection 38. This variation differs from the embodiment shown in FIG. 9, in its structure for installing the clamping member 33 and the sliding member 34 in the base member 31 (not shown in the drawing).

In addition, as the structure and function of each of the members are similar to those of the variation of the first embodiment, their descriptions are omitted. Therefore, the effects of this embodiment also are similar to those of said variation, except for the difference between descending and ascending a slope.

As mentioned above, according to the first or third embodiment, the mountaineering shoes 1–3 have fixtures for adjusting the height of the heel or the toe in accordance with the angle of a slope. One of the structures comprises the clamping member 13 or 33, the sliding member 14 or 34, and the bottom member 15 or 35. Other structures comprise the U-shaped sliding-member 22 or the sliding plate 26 and the cylinders or the cylinder 23.

Consequently, as it is unnecessary to fix or remove these fixtures according to whether one is ascending or descending a slope, or walking in a flat place, the present invention improves the convenience of the shoes in that a man can climb a mountain and walk in a flat place, even in daily life, while the fixture is installed in the shoes.

According to the present invention, when the man ascends or descends a slope wearing the shoes, the body weight is supported in two points that are separated to some extent. Therefore, the stability during a walk is improved compared with the prior art.

Further, the shoe may have two fixtures installed, one in the heel and one in the toe, according to the first, second, or third embodiment. In this case, the present invention includes the effects given by both the fixtures for walking on a slope and in a flat place of these embodiments.

Figure 11:
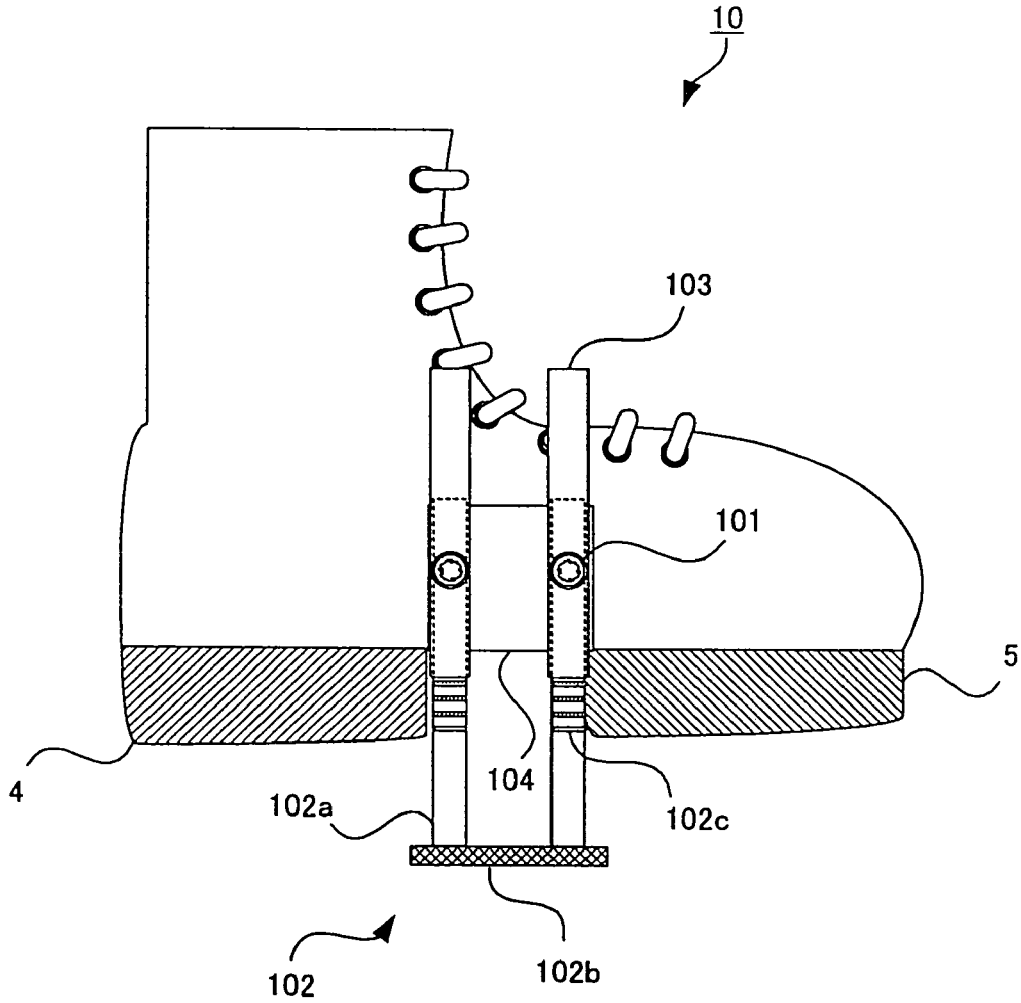
FIG. 11 shows an elevational view of a mountaineering shoe 10 of the fourth embodiment of the present invention.

In reference to FIGS. 11 and 12, the fourth embodiment is described in detail as follows. FIG. 11 shows a structure of a mountaineering shoe 10 with a fixture for walking on a slope of the fourth embodiment of the present invention. The mountaineering shoe 10 comprises two sets of two set screws 101, one U-shaped member 102, two cylinders 103, and one base member 104, arranged in both sides of the mountaineering shoe 10. According to this embodiment, the structures of almost all the members arranged in both sides are similar to those of the members of the fixture installed in the back of the shoe 2 of the second embodiment.

The structure of the base member 104 is U-shaped and similar to that of the base member installed in the heel 4 or the toe 5, according to the first or third embodiment. The base member 104 is fitted along the arched portion and both sides of the shoe 10 and fixed there by set screws arranged in arbitrary locuses of the member 104.

The U-shaped sliding member 102 comprises two vertical sliding members 102*a* arranged at intervals that are equal to those of the cylinders 103 and one bottom member 102*b* fixed to each lower end of the sliding members 102*a*. Like the second embodiment, the number of vertical sliding members may be more than two, and thus equal to that of the cylinders 103 arranged at intervals in accordance with the number. The sectional configuration of the vertical sliding member may be circular, angular, etc.

The cylinder 103 is firmly fixed to the base member 104 by set screws at arbitrary locuses (not shown in the drawings). The cylinders 103 are hollow and parallel to each other so that the vertical sliding member 102*a* can slide in the cylinder 103.

A small hole is arranged at an appropriate height of the cylinder 103 and threaded to be screwed by a set screw 101. The cylinder 103 may be made from any material with an appropriate strength, except metal.

Further, a plurality of transverse slots or recesses 102*c* for engaging the tip of the set screw 101 are preferably arranged at constant intervals in the surfaces of the vertical arm members 102*a* in order to surely lock the U-shaped member 102 to the cylinder 103 by a set screw 101, as shown in FIG. 11.

Next, the procedure for adjusting the height of the side of the shoe 10 is illustrated as follows. The mountaineering shoes 10 of this embodiment are used for walking in a transverse (horizontal) direction on a slope.

In reference to FIG. 11, two set screws 101 for fastening the U-shaped member 102 to the cylinder 103 are loosened. Two vertical arm members 102*a* of the U-shaped member 102 are slid to adjust the height of the side of the shoe 10. The U-shaped member 102 is locked to the cylinder 103 at an appropriate height of the side by tightening the set screws 101 to press the tip of the set screws 101 into the transverse slots or recesses 102*c*.

While the height of the U-shaped member 102 on the side facing a valley is fixed at a desired height, the height of the U-shaped member 102 facing a side of a mountain is equal to that of the sole by the arm member 102*a* on the mountain side being inserted most deeply (most highly) into the cylinder 103.

As mentioned above, a man wearing a pair of the mountaineering shoes 10 with the fixtures of this embodiment can keep almost his natural posture in walking transversally on a slope by using the U-shaped member 102, etc., and adjusting the height of the side of the shoe facing a valley.

An example of the procedure for adjusting the height of one of the shoes is illustrated above. Next, other examples of the procedure for adjusting the heights of both shoes are illustrated as follows. As the shoe facing a mountain side is higher than the shoe facing a valley side in walking transversely on a slope, the shoe on the valley side needs to be arranged more highly than the shoe on the mountain side to better maintain the natural posture. Assuming, for convenience of a description, that the man walks transversely and horizontally on a slope of a mountain while viewing the valley in the right direction (the right foot is on the valley's side), this embodiment is described in detail as follows. After the height of the left shoe is adjusted according to the procedure mentioned above, the left U-shaped member of the right shoe is drawn out longer than the right U-shaped member of the left shoe and, furthermore, the right U-shaped member of the right shoe also is drawn out longer than said left U-shaped member of the right shoe, in accordance with the angle of the slope. According to such procedure, wherein the heights of both shoes differ based on an angle of a slope, the man wearing a pair of shoes with the fixtures of this embodiment can sufficiently maintain his natural posture while walking transversely on the slope.

In FIG. 11, instead of two set screws 101 of the mountaineering shoe 10, a bar 24 with two spring projections 25, each of which is backed by a spring (shown in FIG. 6), may be used in the mountaineering shoe 10. As the structure and function of each of the members were already illustrated in the second embodiment, their illustration and description are omitted here.

Figure 12:
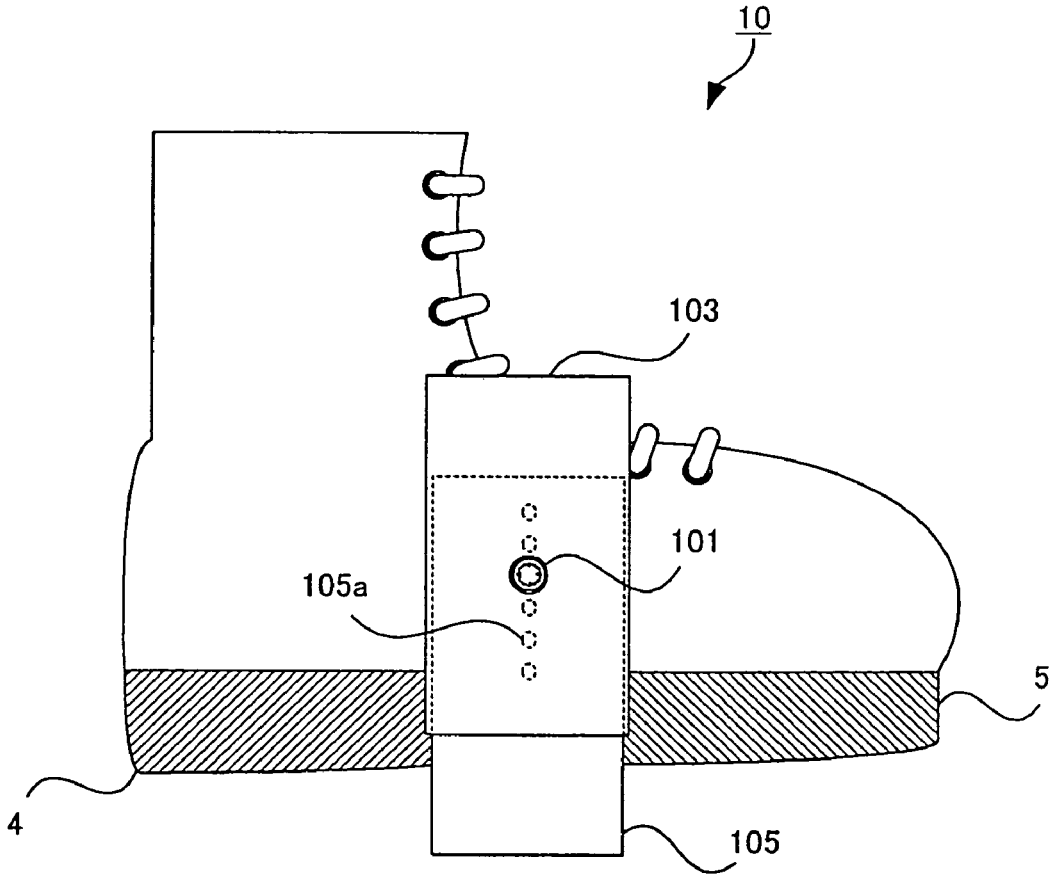
FIG. 12 shows an elevational view of another mountaineering shoe 10, for ascending a slope, of the fourth embodiment of the present invention.

FIG. 12 shows another variation of the mountaineering shoe 10 with the fixture for walking on a slope of the fourth embodiment. In this drawing, the mountaineering shoe 10 comprises one set screw 101, one cylinder 103, and one sliding plate 105 in both sides of the shoe 10. The mountaineering shoe 10 with the fixture for walking on a slope, shown in FIG. 12, differs from the mountaineering shoe 10 shown in FIG. 11 in using one cylinder 103 and one sliding plate 105, instead of two vertical arm members 102*a* and the bottom member 102*b*.

The cross-sectional shape of the cylinder 103 is hollow and rectangular. The sliding plate 105 can slide in the cylinder 103. Like the mountaineering shoe 10 shown in FIG. 11, the cylinder 103 has a threaded hole (not shown in FIG. 12), in which a set screw 101 is screwed to lock the sliding plate 105 to the cylinder 103, at an appropriate height (preferably, below the center of the cylinder 103). Also, this cylinder may be made from any material which has an appropriate strength, except metal.

The sliding plate 105 is a rectangular pillar and has recesses or slots 105*a*, for engaging the set screw 101, at constant intervals, as shown in FIG. 12. This sliding plate 105 also may be made from any material which has an appropriate strength. But, as the metal fixture makes both sides of the shoe 10 heavy and may bring problems in walking, the fixture is preferably made from lightweight and reinforced plastic material.

Further, the fixture of this embodiment does not need a bottom member 102*b*, because it uses one siding plate 105. Therefore, it is advantageous in that this variation can reduce the number of components and simplify the manufacture of the fixture for mountaineering, compared with the variation shown in FIG. 11.

Also, though as in FIG. 12 one set screw is used for fastening the sliding plate 105, a plurality of set screws and small holes may be installed at constant intervals vertically or horizontally. For example, instead of the set screws, the bar having the spring projections as shown in FIG. 6 may be adopted. Of course, it goes without saying that a plurality of set screws fasten more firmly than one set screw the sliding plate 105 to the cylinder 103.

Next, as the procedure for adjusting the height on the valley side of the mountaineering shoe 10 of this variation is similar to those variations shown in FIG. 11, its description is abbreviated here to avoid repeating it.

As mentioned above, according to the fourth embodiment, the mountaineering shoe 10 has the U-shaped members 102 or the sliding member 105 and the cylinders 103 to adjust the heights of both sides in its arched portion in accordance with the angle of a slope.

Consequently, a man wearing the mountaineering shoes 10 of the present invention can maintain his natural posture more easily in walking transversely on a slope while climbing a mountain and can walk more safely than when wearing conventional mountaineering shoes.

Furthermore, a pair of the mountaineering shoes in which the fixtures of these first four embodiments are selectively installed may be used. In such cases, the technical contributions are also combined selectively.

A man wearing the shoes with the fixtures according to the present invention can walk on a slope and a flat place

The invention claimed is:

1. A fixture adapted to be mounted on a shoe, comprising:

a base adapted to be fitted in a location for mounting that is either a heel or a toe of the shoe such that said base encloses both sides and a sole of said location for mounting said shoe when it is fitted in said location for mounting, wherein said base has a bottom, and a pair of arms extending from both ends of said bottom;

a pivotal member, having a lower end, pivotally mounted on said base such that said pivotal member pivotally moves between a first position and a second position about a pivotal shaft, wherein said first position is a horizontal position along the length of the shoe or is located above said horizontal position, and wherein said second position is a vertical position located perpendicular to the horizontal position; and a fixing member coupled to said pivotal member and adapted to fix said pivotal member to the base in a desired pivotal position, wherein the desired pivotal position is such that said lower end of said pivotal member downwardly extends from the bottom of the base by a desired degree, thereby the height of said location for mounting in which the fixture is mounted being able to be adjusted in relation to the slope.

2. A fixture according to claim 1, wherein the angular range of the pivotal movement of said pivotal member is at least 90 degrees.

3. A fixture according to claim 1, wherein said pivotal member includes a pair of sliding members, each sliding member having a longitudinal guiding slot through which said pivotal member is pivotally and slidably mounted on said base.

4. A fixture according to claim 3, further comprising clamping members, each clamping member is respectively attached to each sliding member.

5. A fixture according to claim 4, wherein each sliding member further includes a second longitudinal slot parallel to the longitudinal guiding slot and each clamping member includes a projection adapted to slide in the second longitudinal slot so that the parallel relationship is maintained between said sliding members and said clamping members.

6. A fixture according to claim 3, wherein said sliding members are downwardly slidable from the bottom of the base depending on an inclination of the angle of the slope.

7. A fixture according to claim 1, wherein the distance from the pivotal shaft to the lower end of said pivotal member is such that the pivotal member is capable of pivotally moving between the first position and the second position without adjusting the desired degree.

8. A fixture according to claim 1, wherein said pivotal shaft pivotally mounts said pivotal member to the corresponding arm of said base.

9. A fixture according to claim 1, wherein the fixing member has a threading to be threaded with said pivotal shaft of said pivotal member.

10. A fixture adapted to be mounted on a shoe, comprising:

a base adapted to be fitted in a location for mounting that is either a heel or a toe of the shoe such that said base encloses both sides and a sole of said location for mounting said shoe when it is fitted in said location for mounting, wherein said base has a bottom, and a pair of arms extending from both ends of said bottom;

a pivotal member, having a lower end, pivotally mounted on said base such that said pivotal member pivotally moves between a first position and a second position about a pivotal shaft, wherein said first position is a horizontal position along the length of the shoe or is located above said horizontal position, and wherein said second position is a vertical position located perpendicular to the horizontal position; and a fixing member coupled to said pivotal member and adapted to fix said pivotal member to the base in a desired pivotal position, wherein the desired pivotal position is such that said lower end of said pivotal member downwardly extends from the bottom of the base by a desired degree, thereby the height of said location for mounting in which the fixture is mounted being able to be adjusted in relation to the slope, wherein the fixing member further includes:

extending portions, each extending portion extends from the upper portion of each arm of said base shafts, each shaft is provided with each corresponding extending portion; and an engaging member whose one end is pivotally connected to said pivotal member, said engaging member being provided with a plurality of recesses along the length thereof, wherein said engaging member causes a selected one of said plurality of recesses to fixedly engage with said shaft of said fixing member such that said pivotal member is fixed at the desired pivotal position and wherein said engaging member causes a predetermined one of said plurality of recesses to fixedly engage with said pivotal shaft of said pivotal member without engaging said shaft of said fixing member when said pivotal member is positioned in said first position.

11. A fixture according to claim 10, wherein said engaging member is engaged with said shaft of said extending portion and fixed by means of a threading.

12. A fixture according to claim 1, wherein the fixing member includes:

a spring projection, which is attached to said respective arm and biased by means of a spring so as to outwardly protrude from said respective arm, positioned at a predetermined interval from the pivotal shaft; and a ring, which is rotatably mounted on said pivotal member about the pivotal shaft, having a plurality of holes arranged on the circumference of said ring, for engaging with said spring projection, wherein said spring projection engages with the selected one of said holes such that said pivotal member is fixed at the desired pivotal position.

13. A fixture according to claim 1, wherein said adjusting of the height of the location for mounting to which said base is fitted is done in the ascending slope if the mounting portion is the heel of the shoe, or is done in the downward slope if the mounting portion is the toe of the shoe.

14. A fixture according to claim 1, wherein the fixing member includes a bolt and a set nut coupled to the bolt.

* * * * *